US005201520A

United States Patent [19]

Castle et al.

[11] Patent Number: 5,201,520

[45] Date of Patent: Apr. 13, 1993

[54] BASEBALL GAME APPARATUS

[76] Inventors: Michael R. Castle; Jason M. Castle, both of 3015 Voorheis Lake Ct., Lake Orion, Mich. 48360

[21] Appl. No.: 826,079

[22] Filed: Jan. 27, 1992

[51] Int. Cl.[5] ..... A63F 7/20

[52] U.S. Cl. ..... 273/88; 273/89; 273/93 R

[58] Field of Search ..... 273/88-93 C, 273/277, 244, 148 A

[56] References Cited

U.S. PATENT DOCUMENTS

| | | | |
|---|---|---|---|
| 1,409,033 | 3/1922 | Smiley | 273/93 R |
| 1,533,487 | 4/1925 | White | 273/88 |
| 1,581,189 | 4/1926 | Fuchs | 273/93 R |
| 1,685,428 | 9/1928 | Lowry | 273/89 |
| 2,355,905 | 8/1944 | Buxbaum | 273/88 X |
| 2,462,170 | 2/1949 | Dube | 273/90 |
| 2,812,181 | 11/1957 | Richman | 273/93 C |
| 3,525,525 | 8/1970 | Rideout | 273/89 |
| 3,957,269 | 5/1976 | Bouchard | 273/93 R X |
| 4,251,074 | 2/1981 | Welker | 273/89 |
| 4,735,415 | 4/1988 | Corn | 273/89 |

*Primary Examiner*—V. Millin
*Assistant Examiner*—Sebastiano Passaniti
*Attorney, Agent, or Firm*—Leon Gilden

[57] ABSTRACT

A baseball game is arranged to include baseball cards mounted within associated slots on a game board in a defensive position and positioned at the batter's position in an offensive position, whereupon projection of the baseball cards manually by flicking of the fingers or mechanically through an associated batting apparatus effects establishment of scoring dependent upon the landing of the baseball card subsequent to its being projected onto the associated game board.

4 Claims, 4 Drawing Sheets

BASEBALL GAME APPARATUS

BACKGROUND OF THE INVENTION

1. Field of the Invention

The field of invention relates to game apparatus, and more particularly pertains to a new and improved baseball game apparatus wherein the same is arranged to simulate baseball plate utilizing baseball cards in simulation of popular baseball players.

2. Description of the Prior Art

Baseball toy games of various types have been utilized throughout the prior art and exemplified in the U.S. Pat. No. 4,261,569 to Frohlich wherein a baseball board game utilizes various random numbering system to effect play of the game.

U.S. Pat. No. 4,210,335 to Licciardi sets forth a baseball game utilizing decks of cards for movement about the game board.

U.S. Pat. Nos. 3,528,661 to Warner and 4,822,043 to Carter are further examples of baseball game apparatus of the prior art.

Accordingly, it may be appreciated that there continues to be a need for a new and improved baseball game apparatus as set forth by the instant invention which addresses both the problems of ease of use as well as effectiveness in construction in employing baseball cards selectively receivable within preselected positions about a playing field for simulation of a baseball game in progress.

SUMMARY OF THE INVENTION

In view of the foregoing disadvantages inherent in the known types of baseball game apparatus now present in the prior art, the present invention provides a baseball game apparatus wherein the same utilizes baseball cards and projection of the cards about a game board for effecting scoring in the baseball game play. As such, the general purpose of the present invention, which will be described subsequently in greater detail, is to provide a new and improved baseball game apparatus which has all the advantages of the prior art baseball game apparatus and none of the disadvantages.

To attain this, the present invention provides a baseball game arranged to include baseball cards mounted within associated slots on a game board in a defensive position and positioned at the batter's position in an offensive position, whereupon projection of the baseball cards manually by flicking of the fingers or mechanically through as associated batting apparatus effects establishment of scoring dependent upon the landing of the baseball card subsequent to its being projected onto the associated game board.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved baseball game apparatus which has all the advantages of the prior art baseball game apparatus and none of the disadvantages.

It is another object of the present invention to provide a new and improved baseball game apparatus which may be easily and efficiently manufactured and marketed.

It is a further object of the present invention to provide a new and improved baseball game apparatus which is of a durable and reliable construction.

An even further object of the present invention is to provide a new and improved baseball game apparatus which is susceptible of a low cost of manufacture with regard to both materials and labor, and which accordingly is then susceptible of low prices of sale to the consuming public, thereby making such baseball game apparatus economically available to the buying public.

Still yet another object of the present invention is to provide a new and improved baseball game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
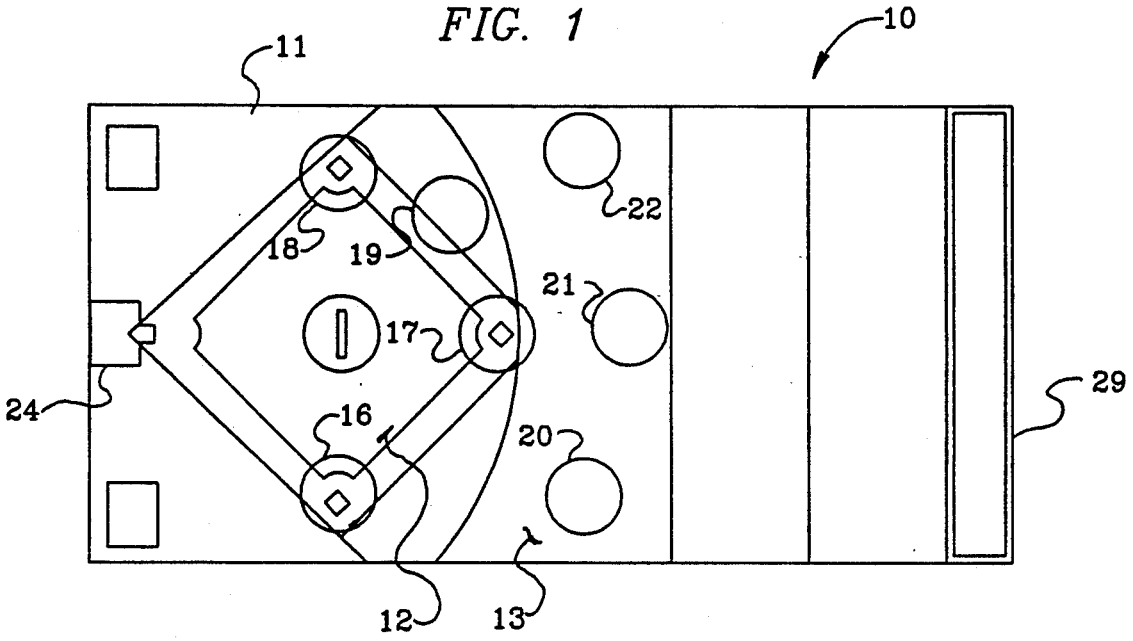
FIG. 1 is a top orthographic view of the game board of the invention.
Figure 2:
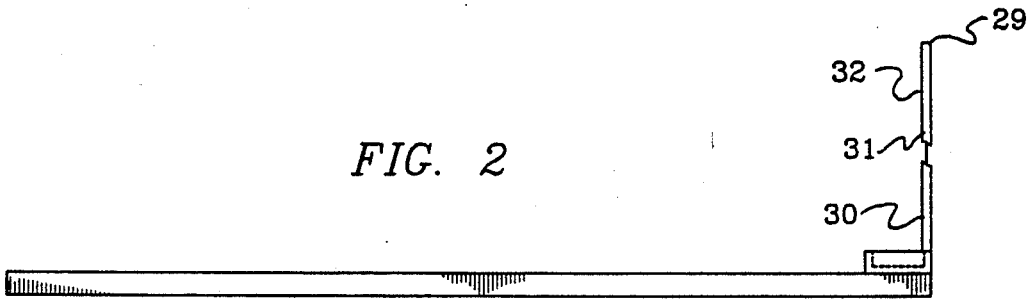
FIG. 2 is an orthographic side view of the game board.
Figure 3:
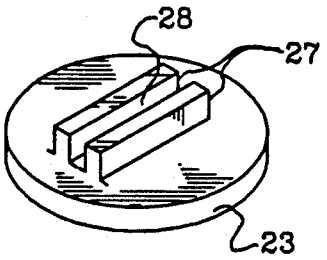
FIG. 3 is an isometric illustration of a baseball card pedestal stand utilized by the invention.

With reference now to the drawings, and in particular to FIGS. 1 to 9 thereof, a new and improved baseball game apparatus embodying the principles and concepts of the present invention and generally designated by the reference numeral 10 will be described.

Figure 4:
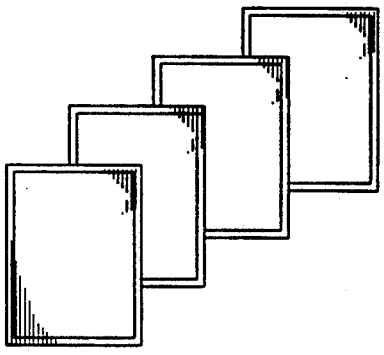
FIG. 4 is an orthographic view of simulated baseball card members utilized by the invention.
Figure 6:
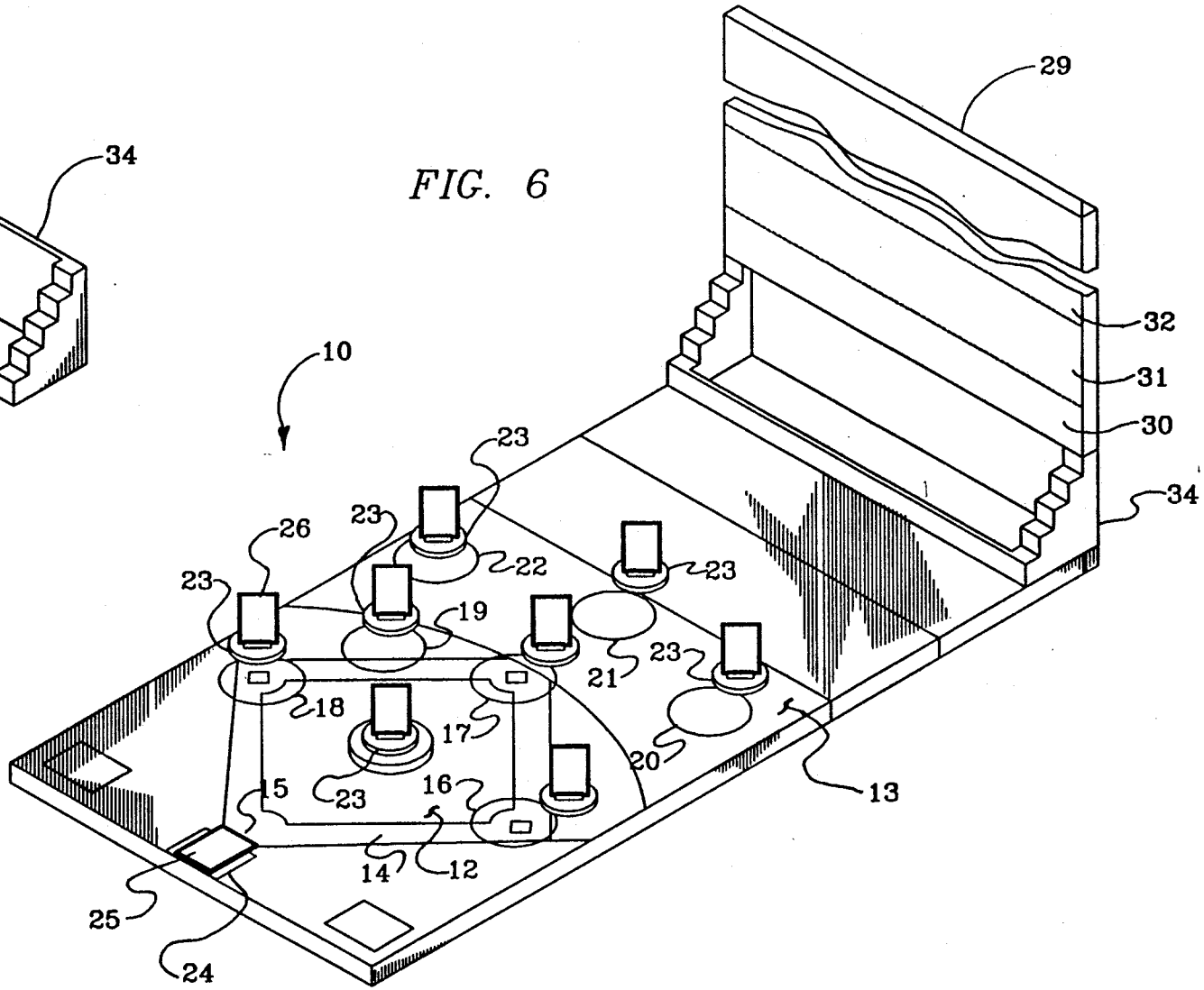
FIG. 6 is an isometric illustration of the invention in an assembled configuration.
Figure 5:
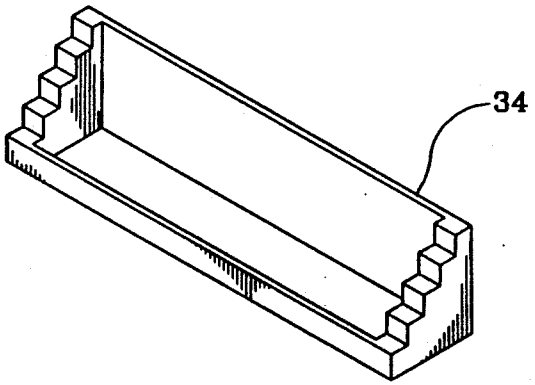
FIG. 5 is an isometric illustration of a bleacher container optionally utilized by the invention.

More specifically, the baseball game apparatus 10 of the instant invention essentially comprises a rigid game board 11 formed with an infield surface 12 and an outfield surface area 13. The infield surface area includes an infield path 14 including a home base portion 15, a first base portion circle 16, a second base portion circle 17, and a third base portion circle 18 to form a diamond shaped conventional configuration and to further include a fourth short-stop circle 19. A respective fifth, sixth, and seventh infield circle 20, 21, and 22 are positioned within the outfield surface area 13. The defending or second team of a first and second team of opposing players is provided with a player base 23 for each of the players. Each team is afforded nine players, and accordingly afforded nine baseball cards such as illustrated in FIG. 4 for use in play of the game. The second team includes a second team batter space 24 positioned adjacent to and rearwardly of the home base portion 15 for use in the offensive position. Each of the nine players of the defense position is afforded the use of a player base 23 of the first team or the defending team, to include a plurality of spaced parallel ribs 27 defining a card slot 28 therebetween. The second team batter space 24 has positioned therein a second team batter card 25 (see FIG. 6 for example) that is arranged in a first configuration to the game apparatus to be flicked utilizing a forefinger and middle finger to project a game onto the game board. Outfield wall 29 is orthogonally mounted to an outer distal end of the game board and may be positioned at various locations relative to the forward end of the game board adjacent the second team batter space 24. The outfield wall is divided into three sections to include a first, second, and third portion 30, 31, and 32 respectively.

In scoring of the game, a batted card landing upon the infield or outfield within a defensive player's circle to include the circles 16–22 inclusively is declared as an out. Each team is afforded three outs per inning as in conventional baseball rules. If a card lands within any of the other areas exteriorly of a circle, the card is depicted as having earned a single or advancing a player to a single base along the infield path 14 of the first, second, and third base portions of the diamond shaped configuration coaxially of the respective first, second, and third circles 16, 17, and 18. A double, or the garnering of a plurality of bases, is effected by directing a card to strike the first portion 30 of the outfield wall 29. A triple is effected by striking the second wall portion or medial third portion of the wall as opposed to the lower third portion of the wall as directed by the first portion 30. The third portion of the wall or the top one-third portion of the wall is declared as a home run. Typically, the wall is twenty seven inches in height and divided into three portions, as discussed above. The circles are typically of four inch circles, but it is understood that any variation of dimensions may be incorporated to accommodate and effect the goals in the structuring of the apparatus of the instant invention. The support container 34 for example is optionally utilized to position the extraneous portions of the game pieces not in use and is positioned forwardly of the wall 29.

Figure 7:
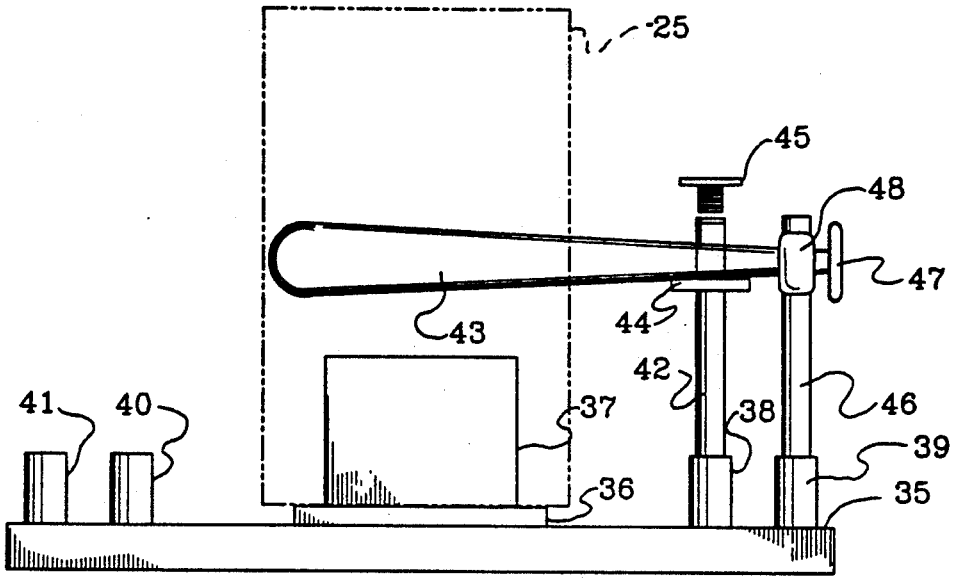
FIG. 7 is an orthographic end view of a modified batter's stand utilized by the invention.
Figure 8:
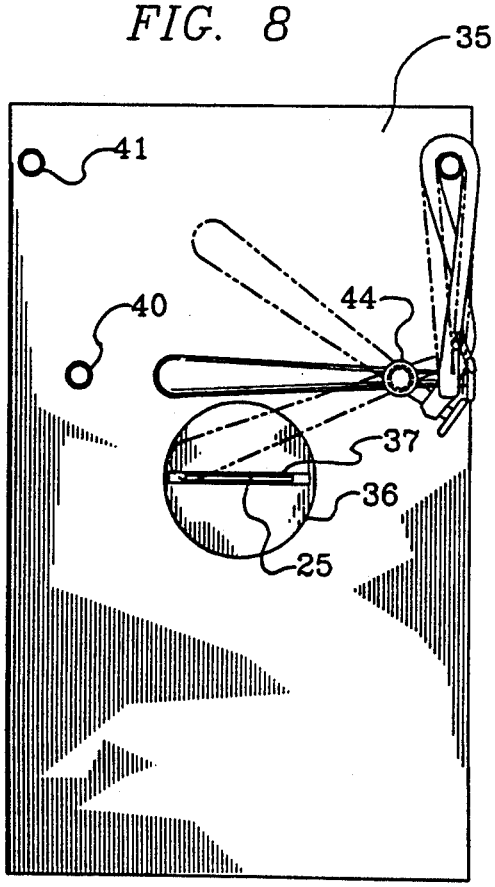
FIG. 8 is an orthographic top view of the batter's stand as set forth in FIG. 7.
Figure 9:
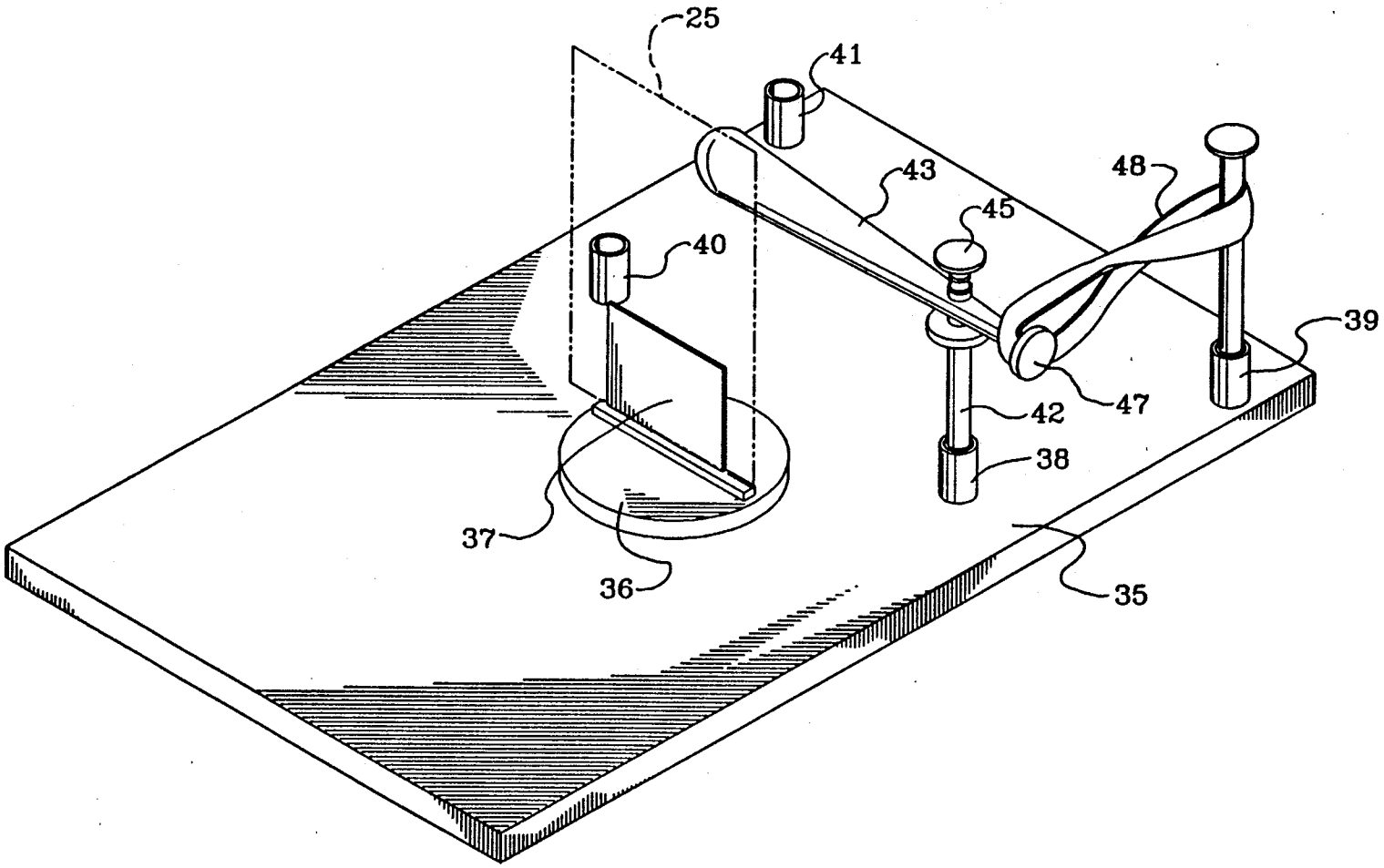
FIG. 9 is an isometric illustration of the modified batter's stand as set forth in the FIGS. 7 and 8.

A modified second team batter space 35 in lieu of the batter space 24 is illustrated in the FIGS. 7–9 to include a base plate 36 positioned medially of the space 35, wherein the base plate 36 includes a vertical support flange 37 extending upwardly thereof diametrically bisecting the base plate 36 to effect positioning of a baseball card 25 thereon. A respective first and second socket tube is utilized in unison for right-handed batters, with a third and fourth socket tube 40 and 41 oriented adjacent an opposed side edge of the base plate 36 for left-handed batters. The first socket tube or the third socket tube receive a first support shaft, with the second and fourth socket tubes 39 and 41 receiving a second support shaft 46. The first support shaft 42 includes a bat member 43 pivotally mounted adjacent an upper distal end thereof in an orthogonal relationship, wherein a rear distal end of the bat member 43 includes a bat member rear flange 47. The first support shaft includes an abutment flange 44 adjacent its upper distal end to provide for a bearing surface for the bat 43. A first support shaft cap head 45 is removably mounted relative to the upper distal end of the first support shaft 42 to permit selective removal of the bat 43 to provide for ease of storage of the organization. The second support shaft 46 includes an elastomeric band 48 secured thereabout, wherein the elastomeric band includes a further end secured about the bat adjacent the bat member rear flange 47. Upon outward pivotment of the bat 43 towards the second support shaft 46 and its subsequent release, striking of the card 25 is effected, in a manner as illustrated in FIG. 8. Reversal of the first and second posts to the third and fourth sockets 40 and 41 is available for left handed batters as noted above, and the procedure is duplicated in this respect to strike the cards 25.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A baseball game apparatus, comprising, a game board, the game board including an infield surface area projecting from a first end of the game board and an outfield surface area projecting from the infield surface area towards a second end of the game board, with the infield surface area including a diamond shaped game path to include a home base portion, a first base circle, a second base circle, and a third base circle, each oriented at an apex of the diamond shaped path, with a fourth shortstop circle positioned rearwardly and medially between the second base circle and the third base circle, and the outfield surface area including a fifth circle, a sixth circle, and a seventh circle, with a first team including a predetermined number of first players and a second team including a predetermined number of second players, each of the players of the first team and second team being depicted by a baseball card, wherein each of the first players is mountable onto a player base, with each player base including a plurality of spaced parallel ribs defining a card slot therebetween for receiving one of said first players within the card slot, and each of the second players being positionable onto a second team batter space, and the second team batter space positioned adjacent to and rearwardly of the home base portion, and an outfield wall orthogonally mounted to a forward distal end of the game board and divided into a first horizontal portion defining a lower third portion of the wall, a second horizontal portion defining a medial third portion of the wall, and a third horizontal portion defining a top third of the wall, and batting means for projecting each of the baseball cards depicting each of the second players, and the batting means including a base plate positioned medially of the second team batter space and the base plate including a vertical support flange diametrically directed along the base plate projecting orthogonally upwardly thereof for mounting one of said baseball cards depicting one of said second players thereon, and a first socket tube and a second socket tube positioned rearwardly of the base plate, wherein the first socket tube includes a first support shaft slidably positioned therewithin, and the second socket tube includes a second support shaft slidably positioned therewithin, the first socket tube includes a bat member pivotally and orthogonally mounted adjacent an upper distal end of the first support shaft, and the second support shaft includes an elastomeric band extending between the second support shaft and the bat member.

2. An apparatus as set forth in claim 1 wherein the bat member includes a bat member rear flange, and the elastomeric band is positioned adjacent the bat member rear flange, and the first support shaft includes a first support shaft abutment flange providing a bearing surface for receiving the bat member rotatably thereon.

3. An apparatus as set forth in claim 2 wherein the first support shaft includes a first support shaft cap head removably mounted relative to an upper distal end of the first support shaft to capture the bat member between the cap head and the first support shaft abutment flange.

4. An apparatus as set forth in claim 3 including a third socket tube and a fourth socket tube positioned rearwardly of the base plate, wherein the third socket tube and the fourth socket tube are spaced from the respective first socket tube and the second socket tube for selectively receiving the first support shaft and the second support shaft therewithin.

* * * * *